US006877654B2

(12) United States Patent
Bartlett et al.

(10) Patent No.: US 6,877,654 B2
(45) Date of Patent: Apr. 12, 2005

(54) DISPOSABLE CONTAINER FOR LIQUIDS WITH MOLDED LINER

(75) Inventors: Glenn J. Bartlett, Winnipeg (CA); Edward F. Urquhart, Bellevue, WA (US)

(73) Assignees: Reliance Products Limited Partnership, Winnipeg (CA); The Seanet Group Inc., Bellevue, WA (US)

( * ) Notice: Subject to any disclaimer, the term of this patent is extended or adjusted under 35 U.S.C. 154(b) by 175 days.

(21) Appl. No.: 10/288,580

(22) Filed: Nov. 6, 2002

(65) Prior Publication Data

US 2004/0084457 A1 May 6, 2004

(51) Int. Cl.[7] ..... B65D 5/74

(52) U.S. Cl. ..... 229/125.15; 229/104; 229/117.15; 222/105

(58) Field of Search ..... 229/125.15, 104, 229/117.15; 220/105

(56) References Cited

U.S. PATENT DOCUMENTS

| | | | | |
|---|---|---|---|---|
| 2,954,901 A | | 10/1960 | Winstead | |
| 3,233,817 A | | 2/1966 | Casady | |
| 3,363,807 A | | 1/1968 | Powell | |
| 4,195,728 A | * | 4/1980 | Cardamone | 206/778 |
| 4,550,828 A | * | 11/1985 | Baldwin et al. | 206/349 |
| 4,781,314 A | | 11/1988 | Schoonover et al. | |
| 4,815,631 A | | 3/1989 | Eeg et al. | |
| 5,715,992 A | | 2/1998 | Andrews, Sr. et al. | |
| 5,909,841 A | | 6/1999 | Andrews, Sr. et al. | |
| 6,053,401 A | | 4/2000 | Andrews, Sr. | |
| 6,062,431 A | | 5/2000 | Geshay | |
| 6,196,452 B1 | | 3/2001 | Andrews, Sr. et al. | |
| 6,209,781 B1 | | 4/2001 | Sylvester et al. | |
| 6,290,124 B1 | | 9/2001 | Andrews, Sr. et al. | |
| 6,375,040 B1 | | 4/2002 | Allanson et al. | |

* cited by examiner

*Primary Examiner*—Joseph Man-Fu Moy
(74) *Attorney, Agent, or Firm*—Adrian D. Battison; Michael R. Williams; Ryan W. Dupuis

(57) ABSTRACT

A container primarily for hot (or cold) beverages such as gourmet coffee has an outer shell formed of a stiff sheet material having heat insulating properties such as cardboard which can be erected from a flat storage condition to enclose an inner lining member for containing the liquid. The inner liner is blow molded from a plastics material to form an integral structure including a neck and a handle projecting through openings in the shell so as to be exposed on an exterior of the container for manual transportation and lifting of the container. The use of a blow molded integral liner allows the handle to be integral with the liner and relatively stiff as a tubular member parallel to an inclined upper surface of the liner. An optional folded leg can be provided to allow the liner to be drained through an optional spigot on the neck. An optional accessory box can be slung on a flap engaged around the neck. The molded liner is translucent allowing the fill level to be observed through a flap window provided in the side wall of the shell.

23 Claims, 7 Drawing Sheets

DISPOSABLE CONTAINER FOR LIQUIDS WITH MOLDED LINER

This invention relates to a disposable container for liquids which includes an inner liquid impermeable liner which can be filled with a liquid and from which the liquid can be discharged and an outer shell member formed of a stiff sheet material having heat insulating properties.

BACKGROUND OF THE INVENTION

Containers of this type have recently become available primarily for "take-away" transporting coffee from gourmet coffee shops to a remote location such as an office for remote consumption. The conventional coffee cup limits the amount which can be carried and is inconvenient to carry a large amount of coffee for a large gathering such as at an office meeting.

However the container disclosed herein is not intended to be limited for use with coffee or other hot beverages and can be used for cold beverages or other liquids.

Six patents and applications of Andrews relating to this subject which are assigned to J&M Coffee Container Company have been located which are U.S. Pat. Nos. 5,715,992; 5,909,841; 6,053,401; 6,196,452; 6,290,124 and U.S. patent application Ser. No. 2002/0047040. This discloses a container of this type which has an inner flexible liner formed from a flat bag with an attached fitment bonded or welded to the bag, and an outer stiff cardboard shell which carries the liner. It has the spout for filling and pouring from the liner in the front wall of the shell. The handle is formed as a folded cardboard handle integral with the outer shell.

Additional prior art patents U.S. Pat. Nos. 3,233,817 (Casady); 4,815,631 (Eeg) and 3,363,807 (Powell) all show similar arrangements.

A further patent of International Dispensing Corporation which is U.S. Pat. No. 6,375,040 (Allanson) issued April 2002 relates to a container of this general type haing a complex handle arrangement which supports an inner liner bag and an outer shell.

Yet further patents in this area also relate to beverage dispensing containers for gourmet coffee and these are U.S. Pat. No. 6,062,431 (Geshay) assigned to BIB Pak Inc.; U.S. Pat. No. 6,209,781 (Sylvester) assigned to Liberty Carton; U.S. Pat. No. 4,781,314 (Schoonover) which relates to a blow molded container and U.S. Pat. No. 2,954,901 (Winstead) which discloses a rectangular molded liner with an integral neck which is inserted within a rectangular box having a handle on one face. However the neck is not intended for a screw cap and the inner liner is molded in two halves and connected together along a diagonal seam.

SUMMARY OF THE INVENTION

It is one object of the present invention to provide an improved container for liquids of the type having an inner liner and an outer shell.

According to one aspect of the invention there is provided a container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the inner lining member including the neck and the opening is an integral molded one-piece body of a plastics material which can be collapsed from an erected condition substantially filling the hollow interior to a collapsed condition for transport.

The closure cap may be a simple cap which is itself closed or may be a valve or spigot which can be opened to allow controlled discharge of the liquid.

Preferably the inner lining member is blow molded which is a technique which readily and effectively forms a liner as an integral molded body formed wholly of plastics material, but other molding or forming methods may be used.

Preferably the inner lining member is semi-rigid so as to maintain an erected shape when inserted into the outer shell to prevent back-flow of liquid through the opening.

Preferably the inner lining member has a flat base and upstanding side walls. While the lining member is preferably rectangular in plan other more complex polygonal or curvilinear shapes may be used.

Preferably the inner lining member is collapsed by folding.

Preferably the inner lining member is semi-rigid to remain substantially in erected condition within the outer shell but collapsible under negative internal pressure to prevent glugging.

Preferably the handle is integrally molded with the inner liner member and projects through an opening in the outer shell member.

Preferably the handle forms a hand graspable member defining an opening between the handle member and a top wall of the inner lining member with each end of the handle member attached to the top wall. In this construction, the handle member preferably forms a hollow tube since this provides a stiff connection of the handle to the liner body. However solid handles can also be readily molded and used and may provide a stiff connection and firm support for the liner and thus the outer shell.

Preferably tubular handle member is pinched at one end to prevent contents of the lining member from entering the tubular handle member at that end.

Preferably the handle is on an inclined surface from one side toward the top and is parallel to the surface and thus itself inclined downwardly from the top since this provides an effective ergonomic support for the container when lifted for pouring.

Preferably the outer shell has top flaps at front and rear with the flaps being separate from the sides.

Preferably the outer shell has at least one slot thereon for passage through the shell of the handle member on inner lining member.

Preferably the outer shell has a separate attachment piece defining a container for accessories which can be attached to the container for transportation therewith.

Preferably the separate attachment piece includes a flap which hangs on an element of the inner liner member projecting through the outer shell, that is the neck or the handle.

Preferably there is provided an optional spigot/tap for attachment to the opening.

Preferably there is provided an optional tilt bottom formed from a foldable portion of the outer shell to lift one end of the outer shell for tilting the inner liner member toward the opening.

Preferably the inner lining member is translucent for viewing a fill level.

Preferably the inner lining member has a portion exposed through the outer shell and there are provided markings for identifying fill level.

Preferably the outer shell has an openable window for viewing the inner liner and there are provided markings on the outer shell for identifying fill level.

According to a second separate independent aspect of the invention there is provided a container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the handle is integrally molded with the inner liner member and projects through an opening in the outer shell member.

In this arrangement, preferably the outer shell has at least one slot thereon for passage through the shell of the handle member on inner lining member In this arrangement, preferably the outer shell has top flaps only at front and rear with the flaps being separate from the sides.

According to a third separate independent aspect of the invention there is provided a container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the inner lining member is blow molded.

In this arrangement, preferably the inner lining member is semi-rigid so as to maintain an erected shape when inserted into the outer shell to prevent back-flow of liquid through the opening.

In this arrangement, preferably the inner lining member is collapsed by folding.

In this arrangement, preferably the inner lining member is semi-rigid to remain substantially in erected condition within the outer shell but collapsible under negative internal pressure to prevent glugging.

According to a fourth separate independent aspect of the invention there is provided a container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein there is provided an optional tilt bottom formed from a foldable portion of the outer shell to lift one end of the outer shell for tilting the inner liner member toward the opening.

According to a fifth separate independent aspect of the invention there is provided a container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the outer shell has a separate attachment piece defining a container for accessories which can be attached to the container for transportation therewith.

In this arrangement, preferably the separate attachment piece includes a flap which hangs on an element of the inner liner member projecting through the outer shell, that is the neck or the handle.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
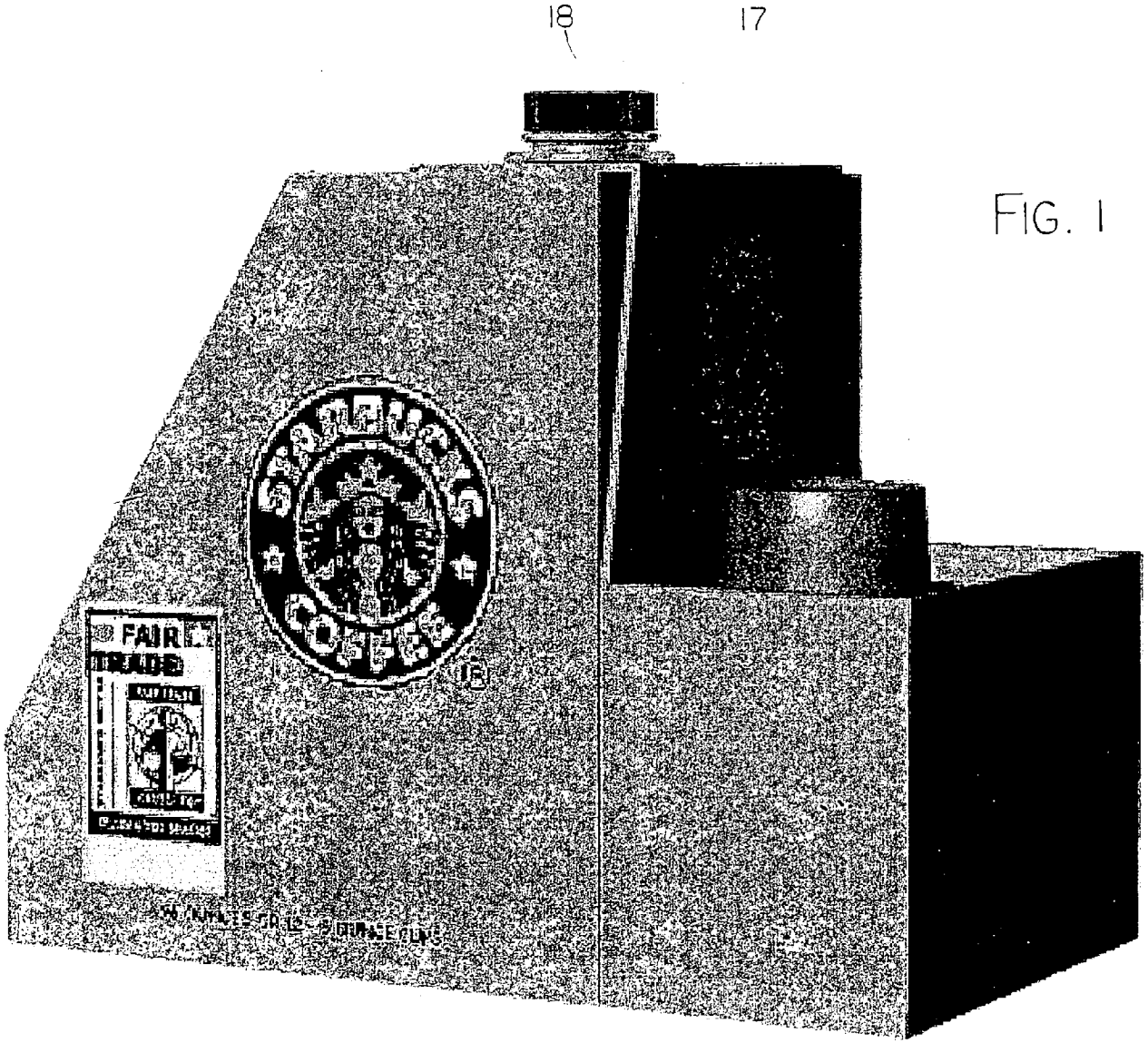
FIG. 1 is an isometric view from the front and one side of a first embodiment of container for liquids according to the present invention.

The container disclosed herein includes an inner liner member 10 and an outer shell 11. The inner liner member 10 is formed to define a semi-rigid container with a flat base 12, upstanding side walls 13A, 13B and 13C and a top wall 14. The container is substantially rectangular so that the side walls 13 are substantially vertical and substantially at right angles. The top wall 14 includes a flat top portion 15 and an inclined section 16 which extends downwardly from the top portion to the rear one of the side walls indicated at 13C. The lining member 12 has at the top portion 15 a neck 17 with a screw thread for receiving a threaded cap 18.

The liner member 10 further has a handle 20 standing up from the inclined upper portion 16 and defining a tubular handle member 21 which extends from the forward end 22 attached to the upper portion 16 to a rearward end 23 also attached to the upper portion 16 at the rear wall 13C. The handle member is hollow and is integral with the liner member. The hollow tubular interior of the handle member connects with the hollow interior chamber of the liner member at the forward end 22. At the rearward end 23 the handle member is pinched as indicated at 23A so as to prevent communication of fluids between the hollow interior of the liner member and the handle.

The liner member is molded as an integral structure including the neck 17 and the handle 20. This structure can be molded using the technique known as blow-molding in which a tubular portion of plastic material in partially molten form is fed into a mold which clamps at top and bottom and air is injected into the interior of the clamped tubular body so as to expand the plastics material onto the inside surface of the mold. The mold at the top where it clamps the plastic material clamps sufficient material to form the neck and the handle, with generally some flashing material which is subsequently cut off. The handle is formed as a tubular structure and its interconnection to the interior of the container allows the air injected into the interior of the container to also inflate the tubular plastics material at the handle so as to form the tubular handle as an integral continuous interior with the container without the necessity for separate injection into the handle. Thus air from the interior passes into the handles through the open forward end 22 where the rear end is pinched to close off the handle from the interior of the container.

Blow molding in this manner forms a structure which is semi rigid. This semi rigid container or liner member has the characteristics that when pulled into its rectangular shape it has sufficient strength to stand without collapsing. The handle stands firmly upwardly from the upper surface and does not flop to either side. However the structure can also be folded by compressing it downwardly so that the top surface including the handle and the neck is folded downwardly onto the bottom wall 12 with the side walls 13 folding inwardly. In this collapsed condition the container can remain folded so that its total volume is reduced to approximately to one quarter of the total volume when expanded to its full height. In this way when folded the containers can be packaged in relatively small volume for transportation and storage. In order to allow the folding, the side walls 13 are slightly bowed inwardly at the center as illustrated. The ability to fold and collapse requires the wall to be relatively thin and such walls are also therefore flexible so that they can flex inwardly when the pressure within the container reduces due to discharge of liquid. Thus liquid can be poured out from the container through the neck 17 by tilting the container without the necessity for the liquid to be replaced by air due to the collapsing of the container inwardly. This avoids the effect known as "glugging" where air is required to return into the container through the same opening thus interfering with the smooth flow of liquid out from the container when poured. Thus the container is semi-rigid and has walls that are sufficiently thin to flex but the walls have sufficient strength so that when expanded the walls hold the top surface away from the bottom surface. Thus the container when erected holds the opening at the neck 17 away from the base so that any liquid poured into the container when erected enters the space between the neck and the bottom surface preventing the bottom surface from causing back-flow of liquid which can occur in a purely flaccid liner.

The outer shell 11 is preferably formed of cardboard as a stiff insulating material. The grade of material selected can vary depending upon the amount of insulation required. In one preferred example the grade of cardboard is of the type having inner and outer sheets with a corrugated section between the sheets thus defining an insulation space between the inner and outer sheets to improve insulation value. However simple paper board can be used in a situation where less insulation is required. Cardboard has the advantage that it can be folded from a flat storage condition to an erect use condition. However, other materials such as fabric or Styrofoam can also be used provided that they provide the necessary properties of sufficient stiffness and sufficient insulation.

The outer shell is formed from a folded and glued box structure using conventional box forming technology so that the box includes a bottom wall 30 which is self erecting and self foldable allowing the box to collapse diagonally with a bottom folding inwardly between the sides.

The outer shell 11 thus forms a rectangular container with vertical sides 31 including a front side 31A a rear side 31C and two sides 31B. The sides 31B in the folded condition collapse together by diagonal collapsing of the box about two opposed corners. In the erected condition the base snaps or connects together to form a flat base wall underlying and receiving the flat bottom 12 of the inner liner member.

The box or shell is shaped to substantially match the shape of the inner liner member. Thus there is a front wall 31A which matches the height of the front 13A of the liner. There is a rear 31C matching the height of the rear 13C of the liner. There is a top section which can be folded so as to lie over the upper surface 14 of the liner covering the upper surface and generally matching its inclination.

Thus the sides 31B include flaps 35 and 36 which can be folded onto the top portion 15 and the incline portion 16 of the liner. A notch 37 divides the portions 35 and 36 so that they can fold about different fold lines. The fold line of the flap 35 is thus horizontal whereas the foldline of the flap 36 is inclined and co-planar with the upper surface 16 of the liner. The flaps 35 and 36 are arranged so that they, when folded, are spaced from the handle and the neck so as not to interfere with those elements when folded onto the top of the liner.

Figure 4:
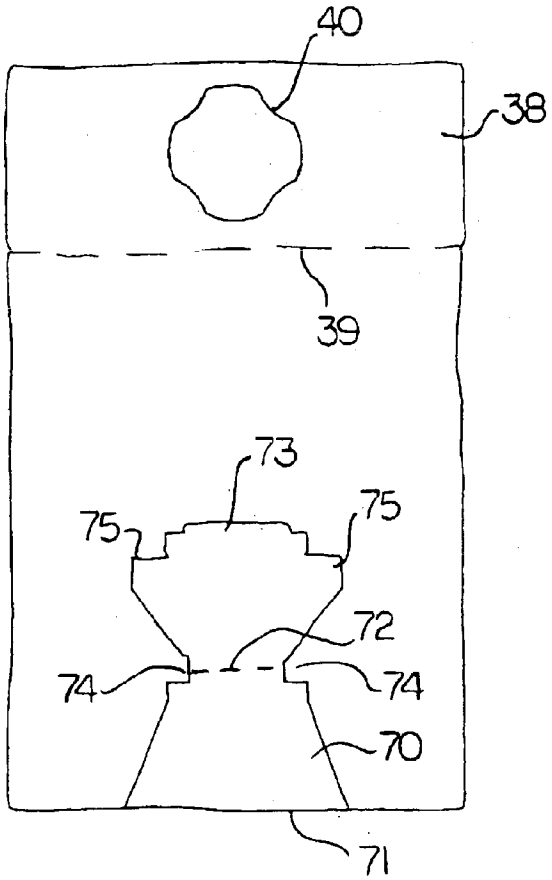
FIG. 4 is an elevational view of the front sheet of the outer shell of the embodiment of FIG. 1.

The front wall 13A is shown in FIG. 4 and includes a top flap 38 foldable about a fold line 39 which can be folded down onto the top portion 15. The flap 38 includes an opening 40 shaped to surround the neck 17 allowing the neck to project through the opening 40. The opening 40 has inwardly projecting elements which frictionally engage the sides of the neck so as to hold the flap down in place onto the neck when the flap is horizontal.

Figure 5:
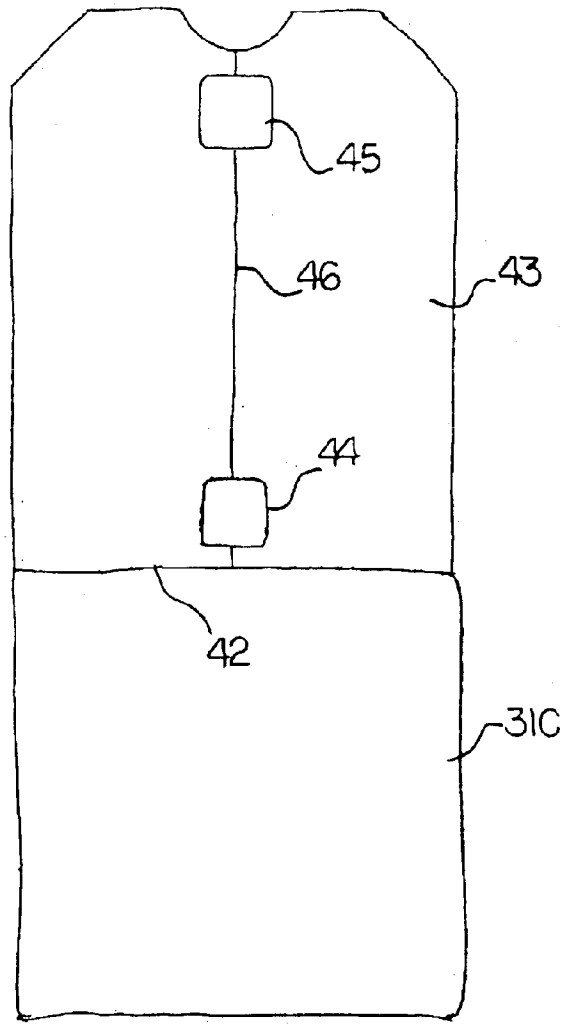
FIG. 5 is an elevational view of the rear sheet of the outer shell of the embodiment of FIG. 1.

The rear surface is shown in FIG. 5 and includes a fold line 42 separating the rear side 31C from a flap 43. The flap 43 includes two openings 44 and 45 each for engaging around a neck part of the handle member 20 with a slot 46 interconnecting the openings so that the slot can pass over the handle into the opening between the handle and the upper surface 16.

Thus in operation, the shell can be stored in a folded condition with the sides flat and the fold lines formed by scoring or compression of the board material. The shell can then be erected by folding out the base so that the sides are moved to their positions at the sides of the rectangular shape and upstanding from the horizontal base 30. In this erected condition, the liner member can be erected from its collapsed condition and inserted into the interior of the outer shell. With the liner in position, the side flaps are folded inwardly and then the flap 38 folded down over the neck and the flap 43 folded down over the handle so as to trap the flaps 35 and 36 underneath the flaps 38 and 43 to enclose the inner liner member within a closed outer shell. In this position, the handle projects through the outer shell so that the whole container can be lifted by the handle 20 which is integral with the inner liner. Also the neck 17 projects through the outer shell so that the cap 18 can be applied. Within the outer shell, the inner liner is erected or extended so that its bottom surface 12 lies against the bottom wall 30.

This erected and assembled condition can be readily and quickly achieved by removing the collapsed pieces from a storage container and quickly assembling them manually to provide the assembled container.

Figure 6:
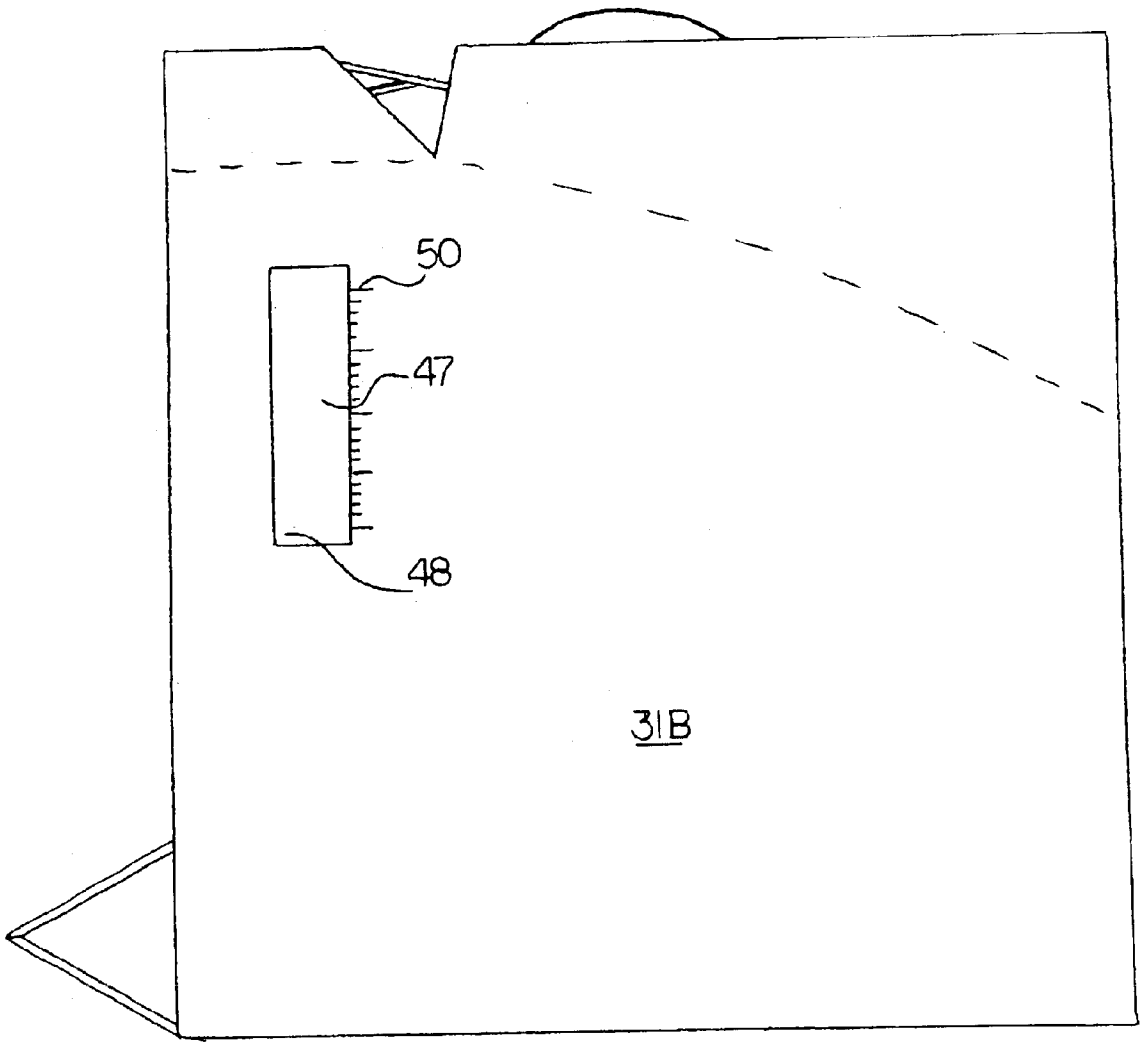
FIG. 6 is a side elevational view of the outer shell of the embodiment of FIG. 1.
Figure 7:
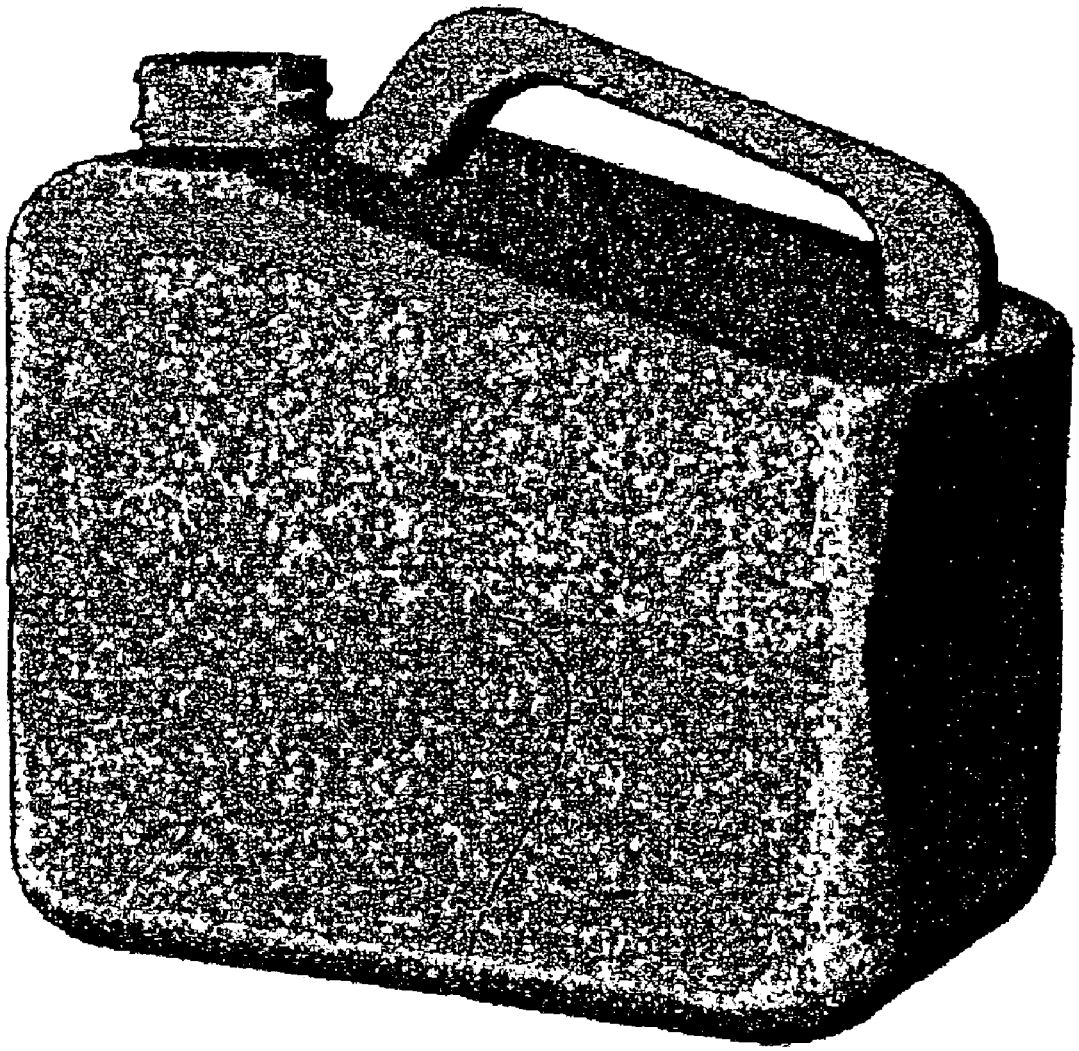
FIG. 7 is an isometric view of the inner lining member of the embodiment of FIG. 1.

On the side 31B as shown in FIG. 6 is provided a window 47 formed in the board material with a hinge line 48 on one side allowing the window to be opened to expose the liner within the shell. The liner is formed from a translucent plastics material so that a level of the liquid within the liner can be observed up to a required fill line. Markings 50 can be provided on the outer shell at the window so that various fill levels can be provided marking pre-determined quantities of liquid within the inner liner.

In use with the container in the erected and assembled condition, the cap 18 can be removed and liquid poured into the hollow interior of the inner liner. Because the inner liner is in an erected condition, there is no splash back or flow back of the liquid since it pours to the bottom of the inner liner thus readily being received within the inner liner up to a filled condition. When filled up to the required fill level as indicated by the markings 50, the window can be closed and the cap 18 reapplied.

This arrangement has the following advantages:

a) The handle is integral on the inner liner so that the structure is more stable and the handle is more rigidly attached to the container as a whole as opposed to an arrangement in which the handle is merely a cardboard flap.

b) The neck is an integral part of the inner liner rather than an adhesively or otherwise attached separate piece.

c) The inner liner is sufficiently structured so that it is held and maintained open thus readily receiving the material when poured.

d) The integral liner has sufficient structural stability so that it can readily pass a "drop test" to avoid breakage and release of the contents.

e) The top flaps are of a simple construction simply folding over the handle and the neck so that they can be readily assembled.

f) When attached to the neck and the handle, the outer shell is stable and remains readily in place.

g) The handle is on the same incline as the inclined top surface so that it makes holding and pouring through the neck more simple.

h) There is a single opening in the inner liner so that the construction is very simple and can be readily sealed.

i) The fill level can be readily viewed.

j) The inner liner is sufficiently flexible so that the liquid can be poured while the liner collapses sufficiently to avoid glugging.

k) The liner member is formed by molding wholly from a suitable plastics material without the necessity for a laminate layer of foil or nylon or the like. Such foils are undesirable since they prevent recycling of the liner member and since they prevent heating of the container by microwave energy.

l) The molded liner member also allows cleaning and reuse of the container since whole of the interior of the liner can be readily washed through the opening at the neck.

m) The arrangement of the handle which is integral with the liner member provides more security for lifting hot liquids and provides an improved ergonomics of handling both for filling and pouring through the single opening at the neck. The location and inclination of the handle keeps the hand away from the hot steam at the neck and allows the user to readily tilt the container for pouring without unsuitable twisting of the wrist.

n) The use of a single opening for filling and pouring forms a simple and secure structure for handling hot liquids without danger of spillage. The location of the single opening allows the dispensing of the liquid by pouring or by draining using the optional spigot.

A first optional arrangement provides a container or caddy for accessories including cups and mixing materials such as sugar and cream. This container comprises a formed rectangular box 60 foldable in the same conventional manner as the main shell to define a base 61 and upstanding sides 62. One of the sides 62A has a top flap portion 63 which extends beyond an open mouth 64 of the box upwardly along the front face 31A to a fold line 65 at which the flap can be folded along the top of the flap 38 to engage around the neck 17. Thus the box or container 60 is hung off the neck along the front face and allows the transport of the accessories in a readily attached manner when the container is carried by the handle. The support of the accessories on the front avoids any interference with the handle and provides a reasonable balance of the weight of the structure. The engagement of the flap 66 around the neck provides a suitable attachment which allows sufficient weight to be carried within the container as required for the quantity of liquid within the container.

The accessory box 60 can be attached onto the container at any other suitable location suspended off the neck or the handle as required.

Figures 2, 3:
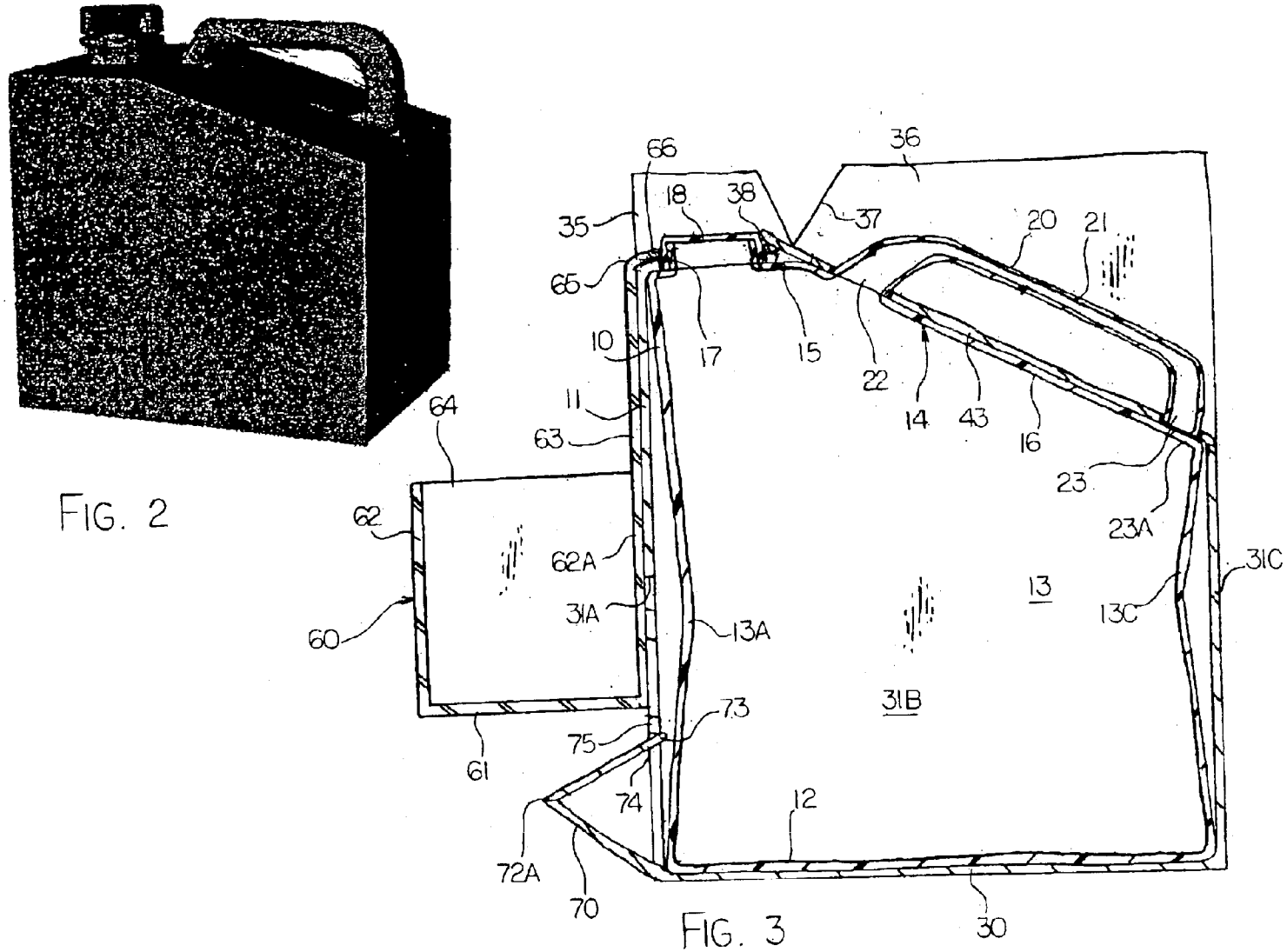
FIG. 2 is an isometric view from the rear and the opposite side of the first embodiment of FIG. 1.
FIG. 3 is a cross sectional view along a center line of the embodiment of FIG. 1.

A second option is shown in FIG. 3 and 4 and comprises a support leg 70 which can be moved to an erected condition shown in FIG. 3. The leg 70 is intended to be used with the accessory box removed and in an arrangement using an optional spigot in replacement for the cap 18. Such spigots are well known and commercially available and can be applied while the opening 17 is upstanding as a replacement for or as an alternative for the simple closure cap. The spigot has a valve allowing liquid to be poured or dispensed. When the spigot is applied, the container can be rotated so that the wall 31A lies on a support surface such as a table. The leg 70 thus raises the base 30 upwardly so that all of the liquid moves to the opening neck 17 and the spigot (not shown) allowing all of the liquid to be dispensed without the necessity for lifting the container and pouring the liquid.

The leg 70 is die cut from the front face 31A so that it is provided as an integral part of the outer shell rather than as a separate piece. Different shapes of foldable leg can be provided as will be well know to one skilled in the art. However one preferred shape is shown in the drawings and provides a hinge line 71 at the bottom. The leg has a central hinge line 72 halfway across the leg so that it can be folded at that hinge line to form an apex 72A which sits on the support surface when the container is rotated to the dispensing position. At the top of the leg 70 is provided a flap portion 73 which tucks in between two notches 74 when the leg is erected. Thus in the erection operation, the die cut leg is broken away from the front face and pulled outwardly about the hinge line 71 so that it forms a flap projecting outwardly from the front face. The flap is then bent around the hinge line 72 so that the flap portion 73 projects backwardly toward the surface 31A. The flap 73 is then tucked back into the hole left by the removal of the flap at the notches 74. Two wings 75 on the leg engage against the sides of the notches 74 so as to hold the leg in place with the apex projecting outwardly from the surface 31A.

Figure 8:
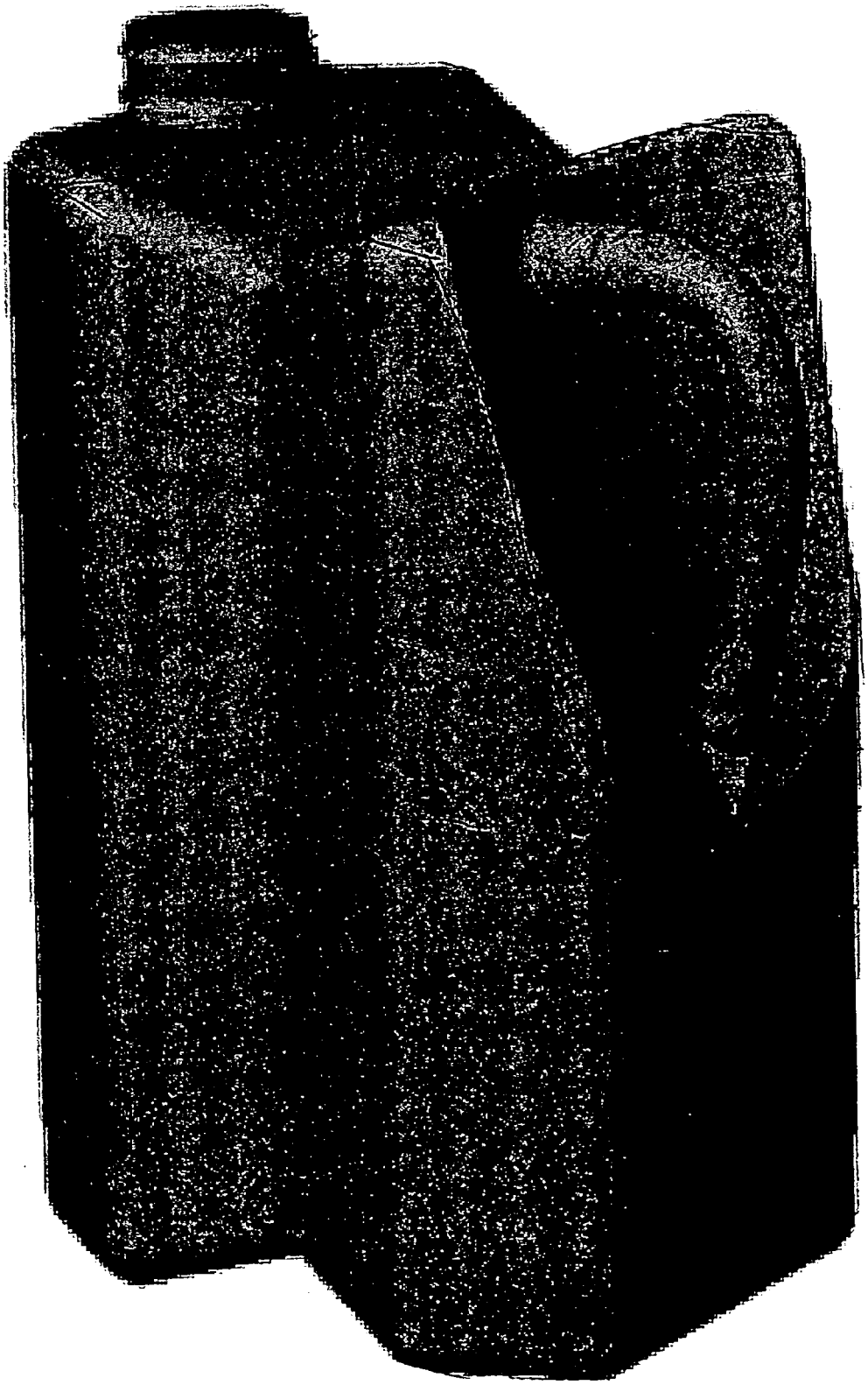
FIG. 8 is an isometric view of the inner lining member of a second embodiment.
Figure 9:
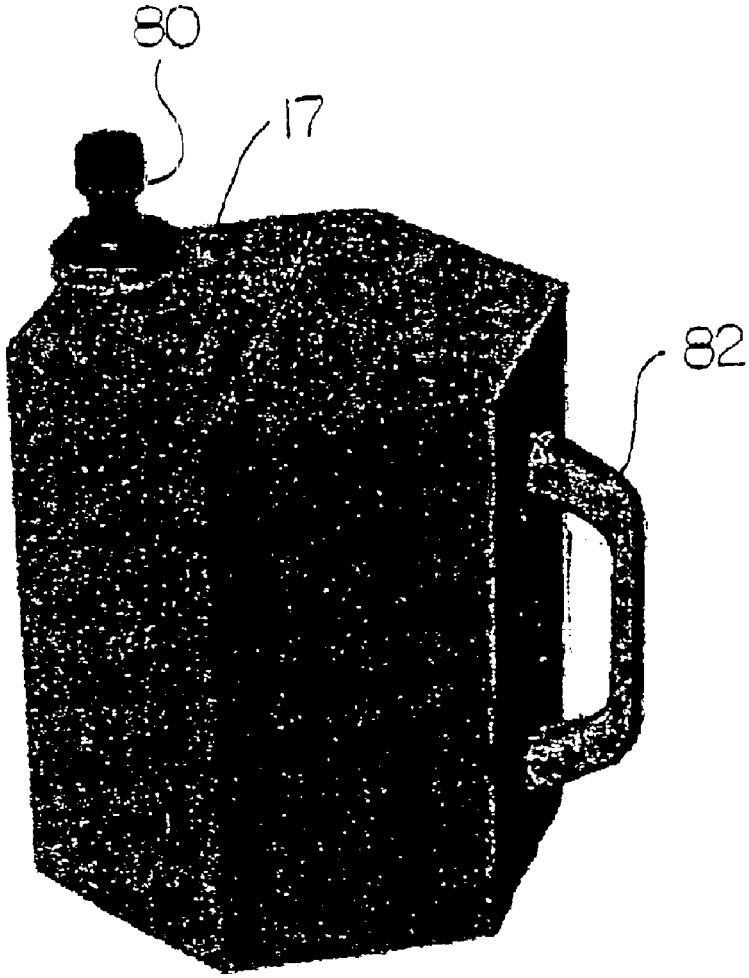
FIG. 9 is an isometric view of a third embodiment.

Alternative shapes of the structure are shown in FIGS. 8 and 9. Thus the inner liner member and its associated shell may not necessarily be rectangular but other more complex polygonal shapes can be used. In FIG. 9, the spigot indicated at 80 as shown is attached to the neck 17.

In FIG. 8, the handle is shown on an inclined surface of the inner liner and this arrangement is preferred since the handle can then be molded as part of the same tubular structure in the blow molding process. However an arrangement less favorable is shown in FIG. 9 in which the handle projects outwardly from the side of the inner container as indicated at 82. In this arrangement the top surface is horizontal.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the inner lining member including the neck and the opening is an integral molded one-piece body of a plastics material which can be collapsed from an erected condition substantially filling the hollow interior to a collapsed condition for transport.

2. The container according to claim 1 wherein the inner lining member is blow molded.

3. The container according to claim 1 wherein the inner lining member is semi-rigid so as to maintain an erected shape when inserted into the outer shell to prevent back-flow of liquid through the opening.

4. The container according to claim 1 wherein the inner lining member has a flat base and upstanding side walls.

5. The container according to claim 1 wherein the inner lining member is collapsed by folding.

6. The container according to claim 1 wherein the inner lining member is semi-rigid to remain substantially in erected condition within the outer shell but collapsible under negative internal pressure to prevent glugging.

7. The container according to claim 1 wherein the handle is integrally molded with the inner liner member and projects through an opening in the outer shell member.

8. The container according to claim 7 wherein the handle forms a hand graspable member defining an opening between the handle member and a top wall of the inner lining member with each end of the handle member attached to the top wall, the handle member forming a hollow tube.

9. The container according to claim 8 wherein tubular handle member is pinched at one end to prevent contents of the lining member from entering the tubular handle member at that end.

10. The container according to claim 7 wherein handle is on an inclined surface from one side toward the top.

11. The container according to claim 1 wherein the outer shell has top flaps at front and rear with the flaps being separate from the sides.

12. The container according to claim 1 wherein the outer shell has at least one slot thereon for passage through the shell of the handle member on inner lining member.

13. The container according to claim 1 wherein the outer shell has a separate attachment piece defining a container for accessories which can be attached to the container for transportation therewith.

14. The container according to claim 13 wherein the separate attachment piece includes a flap which hangs on an element of the inner liner member projecting through the outer shell, that is the neck or the handle.

15. The container according to claim 1 wherein there is provided aspigot/tap for attachment to the opening.

16. The container according to claim 1 wherein there is provided a tilt bottom formed from a foldable portion of the outer shell to lift one end of the outer shell for tilting the inner liner member toward the opening.

17. The container according to claim 1 wherein the inner lining member is translucent for viewing a fill level.

18. The container according to claim 1 wherein the inner lining member has a portion exposed through the outer shell and there are provided markings for identifying fill level.

19. The container according to claim 18 wherein the outer shell has an openable window for viewing the inner liner and there are provided markings on the outer shell for identifying fill level.

20. A container for liquids comprising:

an outer shell member formed of a stiff sheet material having heat insulating properties which can be erected from a flat storage condition into an outer shell defining a base, side walls and a top with a hollow enclosure;

an inner liquid impermeable lining member arranged to be contained within the hollow enclosure for containing the liquid such that when inserted into the outer shell, the outer shell member and the inner lining member can be commonly transported containing the liquid;

a handle exposed on an exterior of the container for manual transportation and lifting of the container;

at least one opening exposed on an exterior of the container communicating with an interior of the lining member for communication of the beverage through the opening, the opening having a neck with a threaded outer end for receiving a threaded closure cap thereon;

wherein the inner lining member is blow molded from a plastics material.

21. The container according to claim 20 wherein the inner lining member is semi-rigid so as to maintain an erected shape when inserted into the outer shell to prevent back-flow of liquid through the opening.

22. The container according to claim 20 wherein the inner lining member is collapsible by folding.

23. The container according to claim 20 wherein the inner lining member is semi-rigid to remain substantially in erected condition within the outer shell but collapsible under negative internal pressure to prevent glugging.

* * * * *